US006978111B2

(12) United States Patent
Nagata et al.

(10) Patent No.: US 6,978,111 B2
(45) Date of Patent: Dec. 20, 2005

(54) METHOD AND DEVICE FOR CLEANING LIQUID DEVELOPMENT ELECTROPHOTOGRAPHIC DEVICE

(75) Inventors: Isao Nagata, Tsubata-machi (JP); Satoshi Sakai, Kanazawa (JP); Hironaga Hongawa, Uchinada-machi (JP); Shigeharu Okano, Hakui (JP); Eri Yamanishi, Hakui (JP); Norihiro Yamasaku, Oyabe (JP)

(73) Assignee: PFU Limited, Ishikawa (JP)

( * ) Notice: Subject to any disclaimer, the term of this patent is extended or adjusted under 35 U.S.C. 154(b) by 113 days.

(21) Appl. No.: 10/481,593

(22) PCT Filed: Jan. 28, 2003

(86) PCT No.: PCT/JP03/00763

§ 371 (c)(1),
(2), (4) Date: Dec. 22, 2003

(87) PCT Pub. No.: WO03/067337

PCT Pub. Date: Aug. 14, 2003

(65) Prior Publication Data

US 2004/0234309 A1 Nov. 25, 2004

(30) Foreign Application Priority Data

Feb. 8, 2002 (JP) ..... 2002-031845
Apr. 30, 2002 (JP) ..... 2002-128341

(51) Int. Cl.[7] ..... G03G 21/00
(52) U.S. Cl. ..... 399/348
(58) Field of Search ..... 399/237, 239, 399/240, 249, 251, 348

(56) References Cited

U.S. PATENT DOCUMENTS 5,592,269 A * 1/1997 Younes et al. ..... 399/237
6,347,212 B1 2/2002 Kosugi et al.
6,748,189 B2 * 6/2004 Vejtasa et al. ..... 399/250

FOREIGN PATENT DOCUMENTS

JP 2000-293044 10/2000
JP 2001-337543 12/2001

* cited by examiner

*Primary Examiner*—Arthur T. Grimley
*Assistant Examiner*—Ryan Gleitz

(57) ABSTRACT

A cleaning apparatus for a liquid-development electrophotographic apparatus in which, after a toner image formed on a surface of an intermediate transfer member by use of a liquid developer is transferred to a printing medium, the liquid developer remaining on the intermediate transfer is removed and collected. The cleaning apparatus includes a cleaning-liquid application device for applying a cleaning liquid to the intermediate transfer member which has transferred an image to the printing medium; a bias voltage application device for applying a bias voltage opposite in polarity to charged toner particles of the developer to the intermediate transfer member; and a collection device for removing the cleaning liquid which has been applied to and the residual developer which remains on the intermediate transfer member from the intermediate transfer member without transfer of an image to the printing medium, and collecting the removed cleaning liquid and residual developer.

11 Claims, 11 Drawing Sheets

Liquid-Development Electrophotographic Apparatus of The Invention

Cleaning Unit 2

Structure of Application Friction Roller 21

Structure of Bias Roller 24

Liquid-Development Electrophotographic Apparatus B01

Conventional Liquid-Development Electrophotographic Apparatus

Liquid-Development Electrophotographic Apparatus B05

METHOD AND DEVICE FOR CLEANING LIQUID DEVELOPMENT ELECTROPHOTOGRAPHIC DEVICE

TECHNICAL FIELD

The present invention relates to a cleaning method and a cleaning apparatus for a liquid-development electrophotographic apparatus which uses a liquid developer (liquid toner), and particularly to a cleaning method and a cleaning apparatus for a liquid-development electrophotographic apparatus which are capable of effectively and stably cleaning off residual developer (residual toner) that coheres and firmly adheres to an intermediate transfer member.

BACKGROUND ART

FIG. 11 shows a conceptual configuration of a conventional liquid-development electrophotographic apparatus. As shown in FIG. 11, the conventional liquid-development electrophotographic apparatus has an intermediate transfer member 51 formed of a roller which is rotated at a predetermined speed; and a backup roller 59 which is in press contact with the intermediate transfer member 51 and is rotated such that a contact portion of the backup roller 59 and a contact portion of the intermediate transfer member 51 move in the same direction. An image formed of liquid toner on the surface of the intermediate transfer member 51 is transferred to a printing medium 60, which is moved while being nipped between the intermediate transfer member 51 and the backup roller 59.

An image to be transferred to the printing medium 60 from the intermediate transfer member 51 consists of a yellow element image, which is in yellow toner and transfer-supplied from a developing unit 54; a red element image, which is in red toner and transfer-supplied from a developing unit 55; a blue element image, which is in blue toner and transfer-supplied from a developing unit 56; and a black element image, which is in black toner and transfer-supplied from a developing unit 57.

The developing unit 54, which transfer-supplies a yellow element image to the intermediate transfer member 51, includes a toner supply pot 54*d* for storing a yellow liquid toner; a pattern roller 54*c* for taking out the liquid toner from the toner supply pot 54*d*; a developing roller 54*b* for leveling the liquid toner supplied from the pattern roller 54*c* so as to form a toner layer of uniform thickness; and a photoconductor drum 54*a* for forming a yellow element image by use of the toner layer transfer-supplied from the developing roller 54*b*.

The yellow liquid toner stored in the toner supply pot 54*d* is supplied in a state of including a carrier, which is a nonvolatile liquid. Thus, the carrier, which is a nonvolatile liquid, adheres to the surface of the intermediate transfer member 51 on which a yellow element image is formed.

Subsequently to being transfer-supplied with a yellow element image, the intermediate transfer member 51 is similarly transfer-supplied with a red element image from the developing unit 55. Then, the intermediate transfer member 51 is sequentially transfer-supplied with a blue element image from the developing unit 56, and a black element image from the developing unit 57, thereby forming a color image as a whole.

Each of the developing unit 55, the developing unit 56, and the developing unit 57 assumes a configuration similar to the aforementioned configuration of the yellow-related developing unit 54. Accordingly, a color image is formed on the surface of the intermediate transfer member 51 by means of yellow liquid toner, red liquid toner, blue liquid toner, and black liquid toner; and a carrier contained in the color toners adheres to the surface of the intermediate transfer member 51.

Although unillustrated in FIG. 11, the surface of the photoconductor drum associated with each of the colors is equipped with, for example, an image formation mechanism for electrostatically forming a latent image, and an accessory mechanism therefor; a mechanism for eliminating static electricity from the surface of the photoconductor drum after transfer-supply of the corresponding element image to the intermediate transfer member 51; and a mechanism for removing residual toner.

When an image formed on the surface of the intermediate transfer member 51 passes a position of contact with a carrier-removing unit 58, the carrier is removed from the image. Then, the image—which is formed of the color toners—is transferred to the printing medium 60, which moves while being nipped under pressure between the backup roller 59 and the intermediate transfer member 51. The image transferred to the printing medium 60 is fixed in a fixing unit (not shown).

After passing a position of transfer to the printing medium 60, a portion of the intermediate transfer member 51 on which an image is previously formed reaches the position of a cleaning unit 52. The cleaning unit 52 removes residues of toner (hereinafter, called "residual toner" or "residual developer"), whereby the intermediate transfer member 51 prepares for a next cycle of forming images in the corresponding colors by means of the developing units 54, 55, 56, and 57.

The conventional cleaning unit 52 shown in FIG. 11 will be described in detail with reference to FIG. 12. The cleaning unit 52 includes a blade 52*a* which is in press contact with the intermediate transfer member 51, and a residual-toner pot 52*b*. The blade 52*a* scrapes off residual toner of firm adhesion from the surface of the intermediate transfer member 51, thereby collecting the residual toner in the residual-toner pot 52*b*.

FIG. 13 shows another conventional cleaning unit. As shown in FIG. 13, the cleaning unit 52 includes an electrically conductive elastic-body roller 62*a* in press contact with the intermediate transfer member 51, and an elastic cleaning blade 62*b* disposed downstream of the roller 62*a*. The electrically conductive elastic-body roller 62*a* is grounded, or a bias voltage opposite in polarity to an electrostatic latent image is applied to the electrically conductive elastic-body roller 62*a*. Specifically, a bias voltage polarized in such a direction as to cause exfoliation of residual toner is applied between the electrically conductive elastic-body roller 62*a* and the intermediate transfer member 51 to thereby exfoliate from the intermediate transfer member 51 residual toner—which coheres/firmly adheres to the intermediate transfer member 51. The elastic cleaning blade 62*b* is adapted to remove, from the intermediate transfer member 51, the residual toner which is exfoliated from the intermediate transfer member 51 by means of the elastic-body roller 62*a*.

Usually, a 4-color image formed on the intermediate transfer member 51 is not entirely transferred to a printing medium. Residual developer (residual toner) which remains on the intermediate transfer member 51 without being transferred to the printing medium is removed in a period of time ranging from the end of a transfer process in which the intermediate transfer member 51 makes one rotation to thereby transfer a toner image to the printing medium, to the start of a subsequent process in which a toner image is transferred from a photoconductor drum to the intermediate transfer member 51. In other words, the residual developer is removed by means of the cleaning unit located upstream of the developing unit 54 and downstream of the backup roller 59, which is disposed in opposition to the intermediate transfer member 51 provided for transferring a toner image to the printing medium.

However, in an ordinary image formation operation, residual toner subjected to a cleaning operation of the cleaning unit is a residue of toner left in transfer of a toner image to the printing medium 60. Thus, the quantity of adhering residual toner is small, but the residual toner adheres firmly to the intermediate transfer member 51. The above-described conventional configuration fails to completely remove such a firmly adhering residual toner.

Furthermore, in the course of repetition of an image formation operation, residual toner which the cleaning unit 52 has failed to collect gradually accumulates and begins to mix in an image formed on the surface of the intermediate transfer member 51, thereby affecting the quality of an image which the intermediate transfer member 51 forms. Meanwhile, for example, when a printing medium is not supplied because of a certain error, most of an image formed on the surface of the intermediate transfer member 51 is subjected to a cleaning operation as residual toner. In such a case, the cleaning operation must handle a large amount of residual toner. Thus, the operation mode of the liquid-development electrophotographic apparatus must be changed over to a cleaning mode for removing residual toner.

Thus, when the number of image formation operations of the liquid-development electrophotographic apparatus reaches a predetermined value or when the liquid-development electrophotographic apparatus suffers an error which requires a recovery operation accompanied by cleaning, an operator changes over the operation mode of the apparatus to a cleaning mode and causes the apparatus to perform the cleaning operation a predetermined number of times, thereby preventing deterioration in the quality of an image formed by means of the intermediate transfer member 51.

Such a conventional cleaning-mode operation to be performed by a liquid-development electrophotographic apparatus will be described with reference to FIGS. 14 and 15. A configuration required for description of a control procedure will be described with reference to the block diagram of FIG. 14. An arithmetic control section B50 contained in a liquid-development electrophotographic apparatus B05 fetches a required program segment from a control program stored in a control program section B58 and executes a predetermined control procedure.

A printing drive section B51 includes a drive system for driving the intermediate transfer member 51, and a press-contact drive system for driving the backup roller 59. An image formation section B52 includes drive systems for driving the corresponding developing units 54, 55, 56, and 57, and a drive system for driving the carrier-removing unit 58.

An error detection section B55 reports to the arithmetic control section B50 signals obtained from various error detection sensors disposed in the liquid-development electrophotographic apparatus B05.

A printing control section B56*a* specifies an operation which the printing drive section B51 is to perform, timing of performing the operation, and the like; and a development control section B56*b* specifies an operation which the image formation section B52 is to perform, timing of performing the operation, and the like.

Control procedure will be described with reference to the flowchart of FIG. 15. For example, when the number of image formation operations performed by the liquid-development electrophotographic apparatus B05 reaches a predetermined value, or when the liquid-development electrophotographic apparatus B05 suffers an error which requires a recovery operation accompanied by cleaning, the liquid-development electrophotographic apparatus B05 indicates necessity to perform cleaning. As a matter of course, the degree of contamination of the intermediate transfer member depends on the contents of an image which the liquid-development electrophotographic apparatus B05 forms. Thus, an operator must monitor the conditions of printing media ejected from the liquid-development electrophotographic apparatus B05 and set an appropriate timing of performing cleaning.

In Step S51, the operator selects a cleaning mode as an operation mode of the liquid-development electrophotographic apparatus B05. This causes the arithmetic control section B50 to fetch a program segment associated with the cleaning mode from the control program section B58 and to execute the program segment.

In Step S52, the development control section B56*b* retreats the image formation section B52. Specifically, this retreat operation causes the developing units 54, 55, 56, and 57 and the carrier-removing unit 58 to separate from the intermediate transfer member 51.

In Step S53, the printing control section B56*a* retreats the printing drive section B51. Specifically, this retreat operation causes the backup roller 59 to separate from the intermediate transfer member 51.

In Step S54, the arithmetic control section B50 starts a cleaning operation. Specifically, in this cleaning operation, the intermediate transfer member 51 rotates for a predetermined period of time while remaining in contact with the cleaning unit 52.

In Step S55, the arithmetic control section B50 ends the cleaning operation. Then, proceeding to Step S56, the arithmetic control section B50 cancels the retreat operation of the image formation section B52 and the retreat operation of the printing drive section B51 performed for the cleaning mode. Then, proceeding to Step S57, the arithmetic control section B50 stands by in preparation for the subsequent image formation mode.

As described above, since the degree of contamination of the intermediate transfer member depends on the contents of an image which the liquid-development electrophotographic apparatus forms, an operator must monitor the conditions of printing media ejected from the liquid-development electrophotographic apparatus and set appropriate cleaning conditions.

DISCLOSURE OF THE INVENTION

Prior to the step of transferring an image from an intermediate transfer member to a printing medium, in order to prevent deterioration in printing quality stemming from wetting of the printing medium or a like cause, a carrier liquid, which is a liquid component of a liquid developer, must be appropriately removed from the liquid developer (toner image) transferred to the intermediate transfer member. In so doing, toner solids (resin containing pigment or dye) contained in the liquid developer cohere/firmly adhere to the intermediate transfer member.

Residual developer which remains on the intermediate transfer member without being transferred to the printing medium coheres/firmly adheres to the intermediate transfer member in a stubborn manner. Specifically, at the time of transfer to the printing medium, the liquid developer is heated to a temperature equal to or higher than the softening point of toner solids (resin containing pigment or dye) contained in the liquid developer, and is subjected to high pressure. Accordingly, residual developer which remains on the intermediate transfer member without being transferred to the printing medium coheres/firmly adheres to the intermediate transfer member in a stubborn manner.

The present invention has been accomplished in view of the foregoing, and an object of the invention is to effectively and stably clean off residual developer which coheres/firmly adheres to the intermediate transfer member in a stubborn manner, when a liquid-development electrophotographic apparatus using a liquid developer performs cleaning.

Since difficulty is encountered in completely collecting residual toner which stubbornly and firmly adheres to the intermediate transfer member, uncollected residual toner accumulates, and thus an unnecessary image component tends to appear on a formed image. Therefore, repeated image formation involves deterioration in image quality.

Thus, another object of the present invention is to construct a foundation for optimally setting cleaning conditions for different degrees of contamination of the intermediate transfer member through performance of a cleaning operation suited for the details of an error arising in the liquid-development electrophotographic apparatus.

According to the present invention, a cleaning liquid is applied to the intermediate transfer member which has transferred an image to the printing medium, to thereby weaken cohesion/firm adhesion of residual developer to the intermediate transfer member and again liquefy the residual developer cohering/firmly adhering to the intermediate transfer member. Furthermore, in order to exfoliate residual developer, which coheres/firmly adheres to the intermediate transfer member, from the intermediate transfer member, a bias voltage is applied to the intermediate transfer member. The residual developer exfoliated from the intermediate transfer member is collected together with the cleaning liquid.

A cleaning method of the present invention for a liquid-development electrophotographic apparatus using a liquid developer comprises a cleaning-liquid application step of applying a cleaning liquid to the intermediate transfer member which has transferred an image to the printing medium; a bias voltage application step of applying, to the intermediate transfer member, a bias voltage opposite in polarity to charged toner particles of the residual developer (a bias voltage polarized in such a direction as to cause exfoliation of the developer); and a collection step of removing, from the intermediate transfer member, the cleaning liquid which has been applied in the cleaning-liquid application step, and the residual developer which remains on the intermediate transfer member without transfer of an image to the printing medium, and collecting the removed cleaning liquid and residual developer.

A cleaning apparatus of the present invention for a liquid-development electrophotographic apparatus using a liquid developer is configured such that a cleaning unit for removing residual developer from the intermediate transfer member is disposed upstream of a developing unit and downstream of a backup roller, which is disposed in opposition to the intermediate transfer member so as to transfer a toner image to a printing medium. This cleaning unit comprises a cleaning-liquid application mechanism for applying a cleaning liquid to the intermediate transfer member which has transferred an image to the printing medium; a bias voltage application mechanism for applying, to the intermediate transfer member, a bias voltage opposite in polarity to charged toner particles of the developer (a bias voltage polarized in such a direction as to cause exfoliation of the developer); and a collection mechanism for removing, from the intermediate transfer member, the cleaning liquid which has been applied by means of the cleaning-liquid application mechanism, and the residual developer which remains on the intermediate transfer member without transfer of an image to the printing medium, and collecting the removed cleaning liquid and residual developer.

BEST MODE FOR CARRYING OUT THE INVENTION

Figure 1:
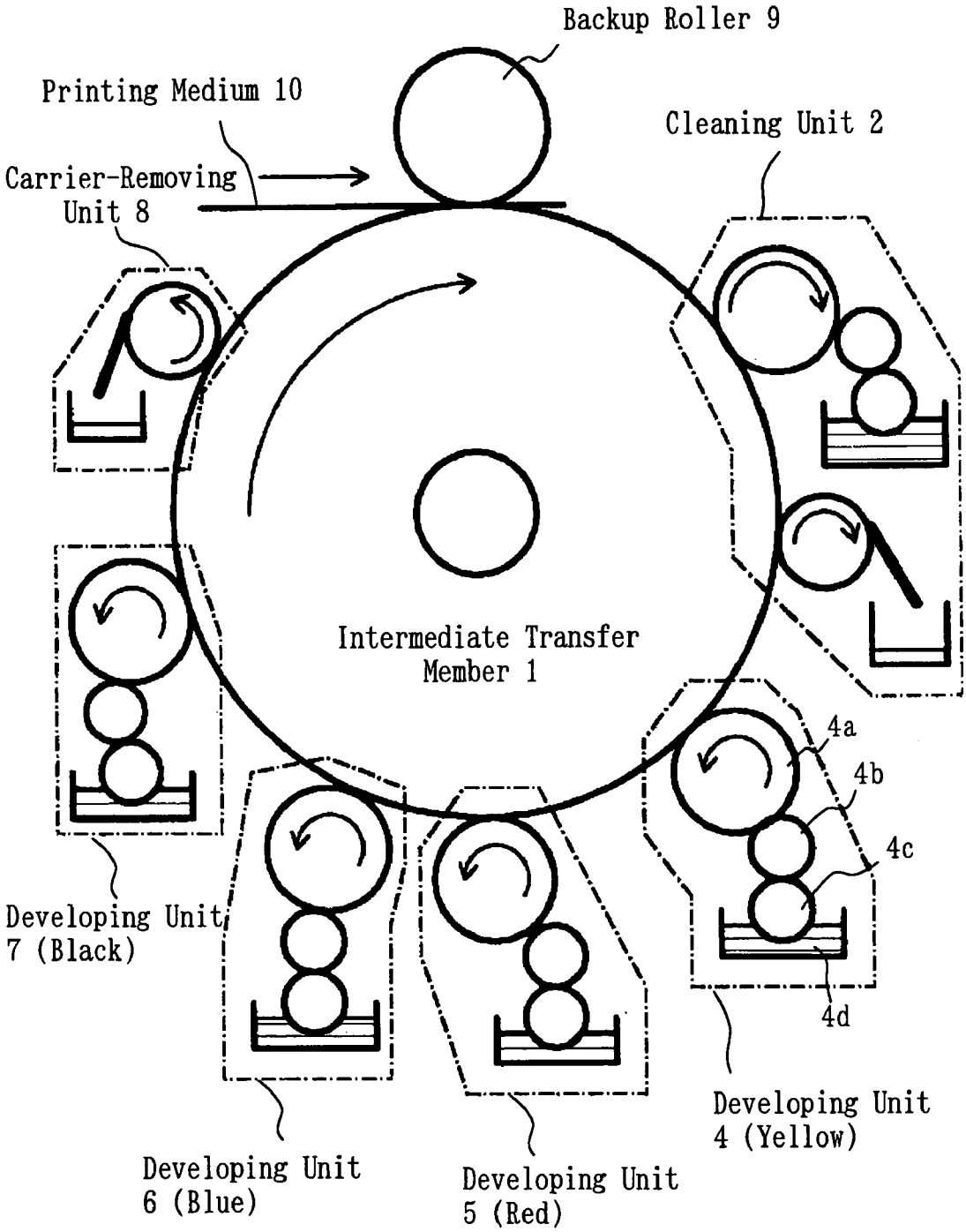
FIG. 1 is a conceptual view showing the configuration of a liquid-development electrophotographic apparatus including a first example of a cleaning apparatus to which the present invention is applied.

A cleaning method and apparatus for a liquid-development electrophotographic apparatus according to the present invention will next be described, by way of example. FIG. 1 is a conceptual view showing the configuration of a liquid-development electrophotographic apparatus including a first example of a cleaning apparatus to which the present invention is applied.

As shown in FIG. 1, the liquid-development electrophotographic apparatus includes an intermediate transfer member 1 which is rotated at a predetermined speed and assumes a roller shape; and a backup roller 9 which is in press contact with the intermediate transfer member 1 and is rotated such that a contact portion of the backup roller 9 and a contact portion of the intermediate transfer member 1 move in the same direction. An image formed of liquid toner on the surface of the intermediate transfer member 1 is transferred to a printing medium 10, which is moved while being nipped between the intermediate transfer member 1 and the backup roller 9.

An image to be transferred to the printing medium 10 from the intermediate transfer member 1 consists of a yellow element image, which is in yellow toner and transfer-supplied from a developing unit 4; a red element image, which is in red toner and transfer-supplied from a developing unit 5; a blue element image, which is in blue toner and transfer-supplied from a developing unit 6; and a black element image, which is in black toner and transfer-supplied from a developing unit 7.

The developing unit 4, which transfer-supplies a yellow element image to the intermediate transfer member 1, includes a toner supply pot 4*d* for storing yellow liquid toner; a pattern roller 4*c* for taking out the liquid toner from the toner supply pot 4*d*; a developing roller 4*b* for leveling the liquid toner supplied from the pattern roller 4*c* so as to form a toner layer of uniform thickness; and a photoconductor drum 4*a* for forming a yellow element image by use of the toner layer transfer-supplied from the developing roller 4*b*.

Although unillustrated in FIG. 1, the surface of the photoconductor drum 4*a* is equipped with, for example, an image formation mechanism for electrostatically forming a latent image, along with an accessory mechanism therefor; a mechanism for eliminating static electricity from the surface of the photoconductor drum 4*a* after transfer-supply of a yellow element image to the intermediate transfer member 1; and a mechanism for removing residual toner.

The yellow liquid toner stored in the toner supply pot 4*d* is supplied in a state including a carrier, which is a nonvolatile liquid. Thus, the carrier, which is a nonvolatile liquid, adheres to the surface of the intermediate transfer member 1 on which a yellow element image is formed.

Subsequently to being transfer-supplied with a yellow element image, the intermediate transfer member 1 is transfer-supplied with a red element image from the developing unit 5. Then, the intermediate transfer member 1 is sequentially transfer-supplied with a blue element image from the developing unit 6, and a black element image from the developing unit 7, thereby forming a color image as a whole.

Each of the developing units 5, 6, and 7 assumes a configuration similar to the aforementioned configuration of the developing unit 4. Accordingly, an image is formed on the surface of the intermediate transfer member 1 by means of yellow liquid toner, red liquid toner, blue liquid toner, and black liquid toner; and the carrier contained in the color toners adheres to the surface of the intermediate transfer member 1.

When an image formed on the surface of the intermediate transfer member 1 passes a position of contact with a carrier-removing unit 8, the carrier is separated and removed from the image. Then, the image, formed of the color toners, is transferred to the printing medium 10, which moves while being nipped under pressure between the backup roller 9 and the intermediate transfer member 1. Notably, the carrier-removing unit 8 is adapted to remove a carrier oil contained in an image which is formed on the intermediate transfer member 1 by means of liquid toners. The image transferred to the printing medium 10 is fixed in a fixing unit (not shown).

Figure 11:
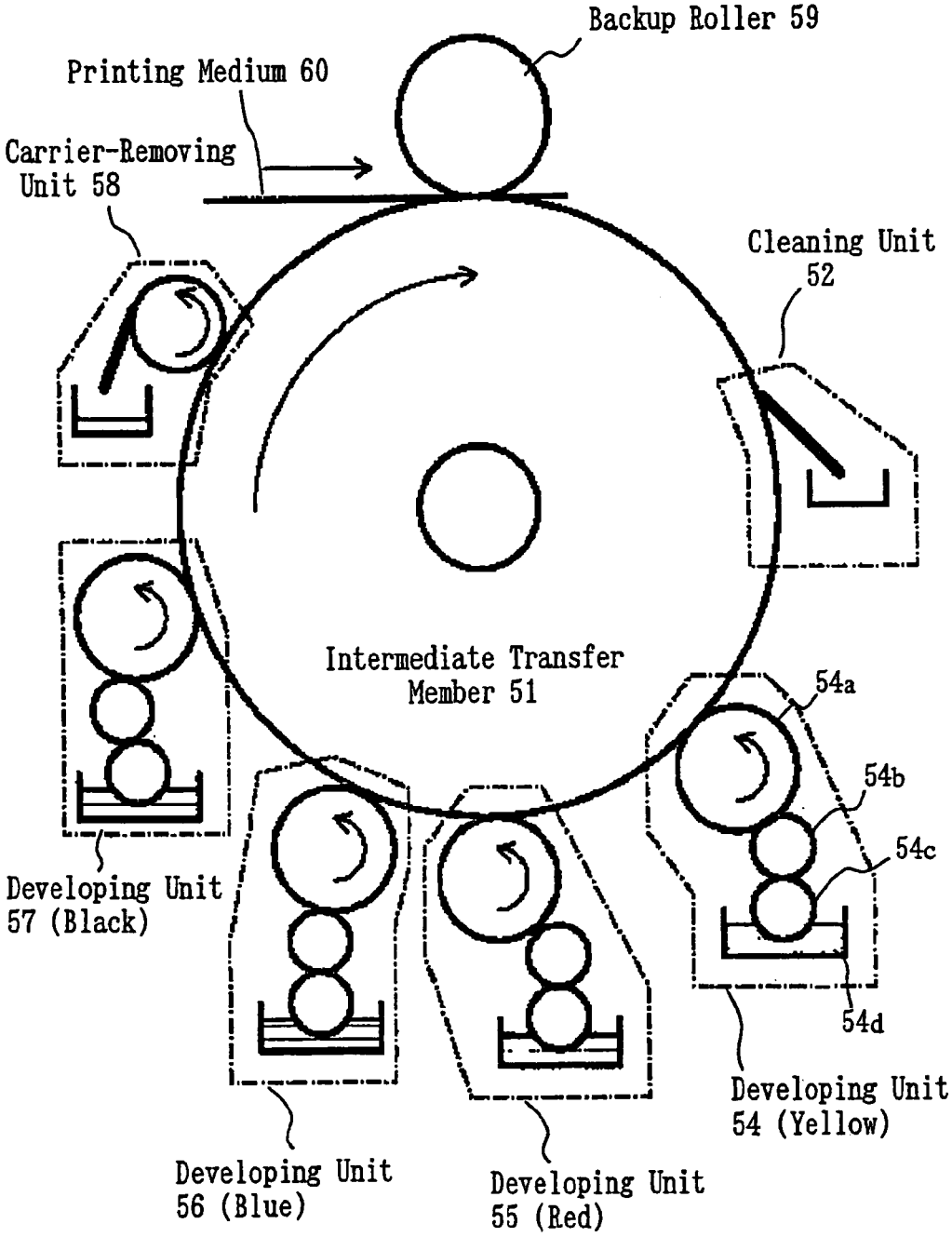
PRIOR ART Fig.11
FIG. 11 is a conceptual view showing the configuration of a conventional liquid-development electrophotographic apparatus.
Figure 12:
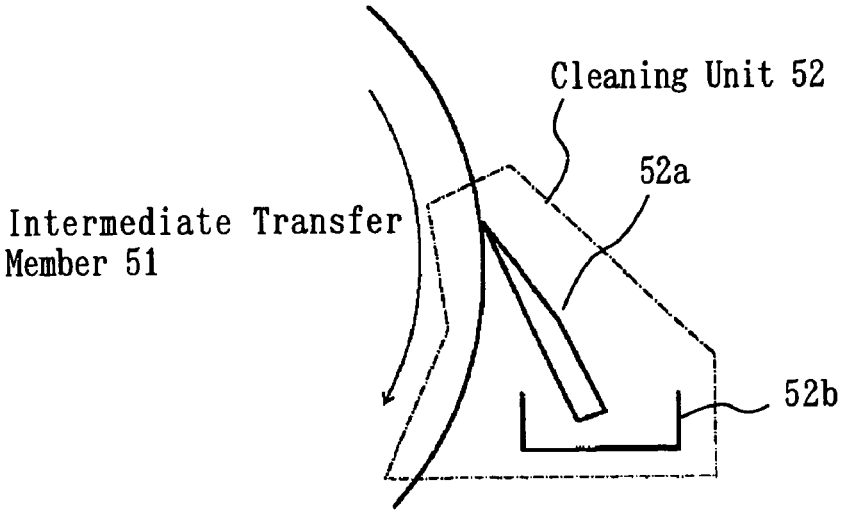
Fig.12 Prior Art
FIG. 12 is a view showing the details of a conventional cleaning unit shown in FIG. 11.
Figure 13:
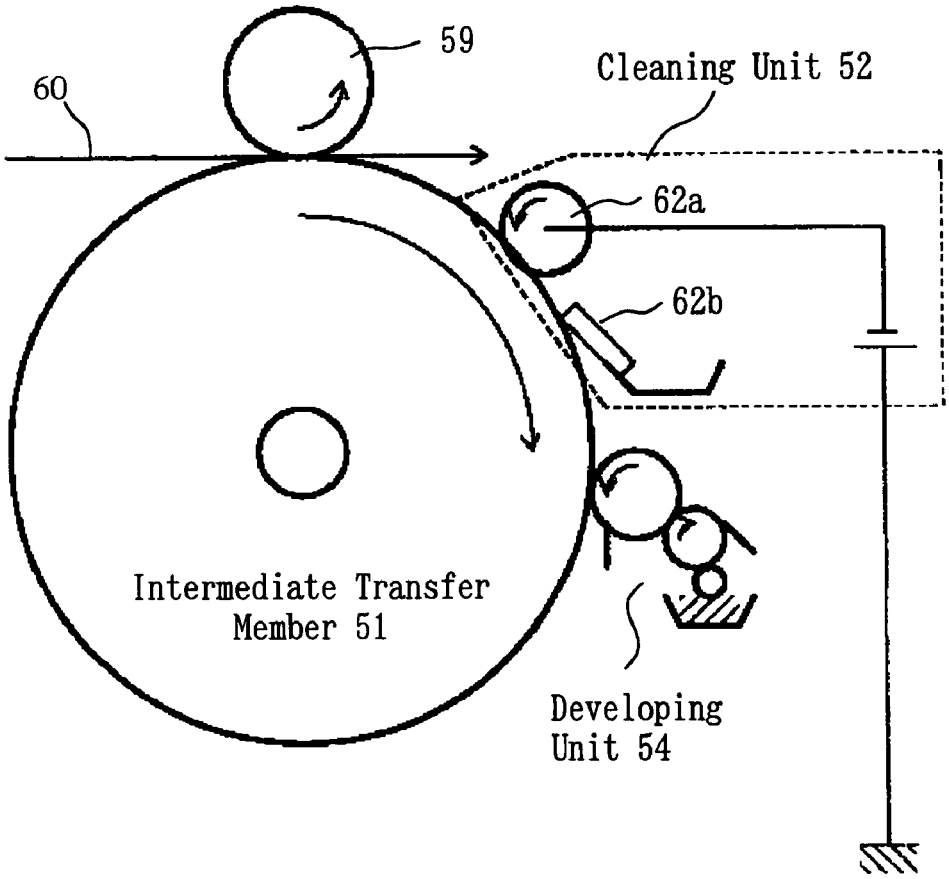
Fig.13 Prior Art
FIG. 13 is a view showing another example of a conventional cleaning unit.
Figure 14:
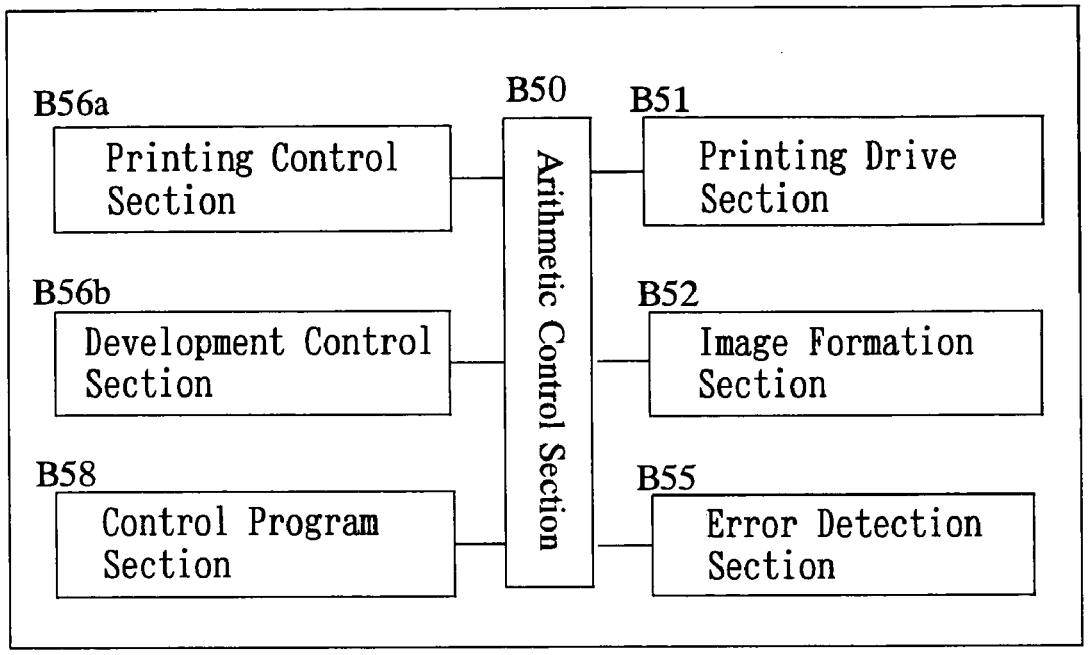
Fig.14 Prior Art
FIG. 14 is a block diagram for explaining a control system configuration for controlling a cleaning operation which the conventional liquid-development electrophotographic apparatus performs in a cleaning mode.
Figure 15:
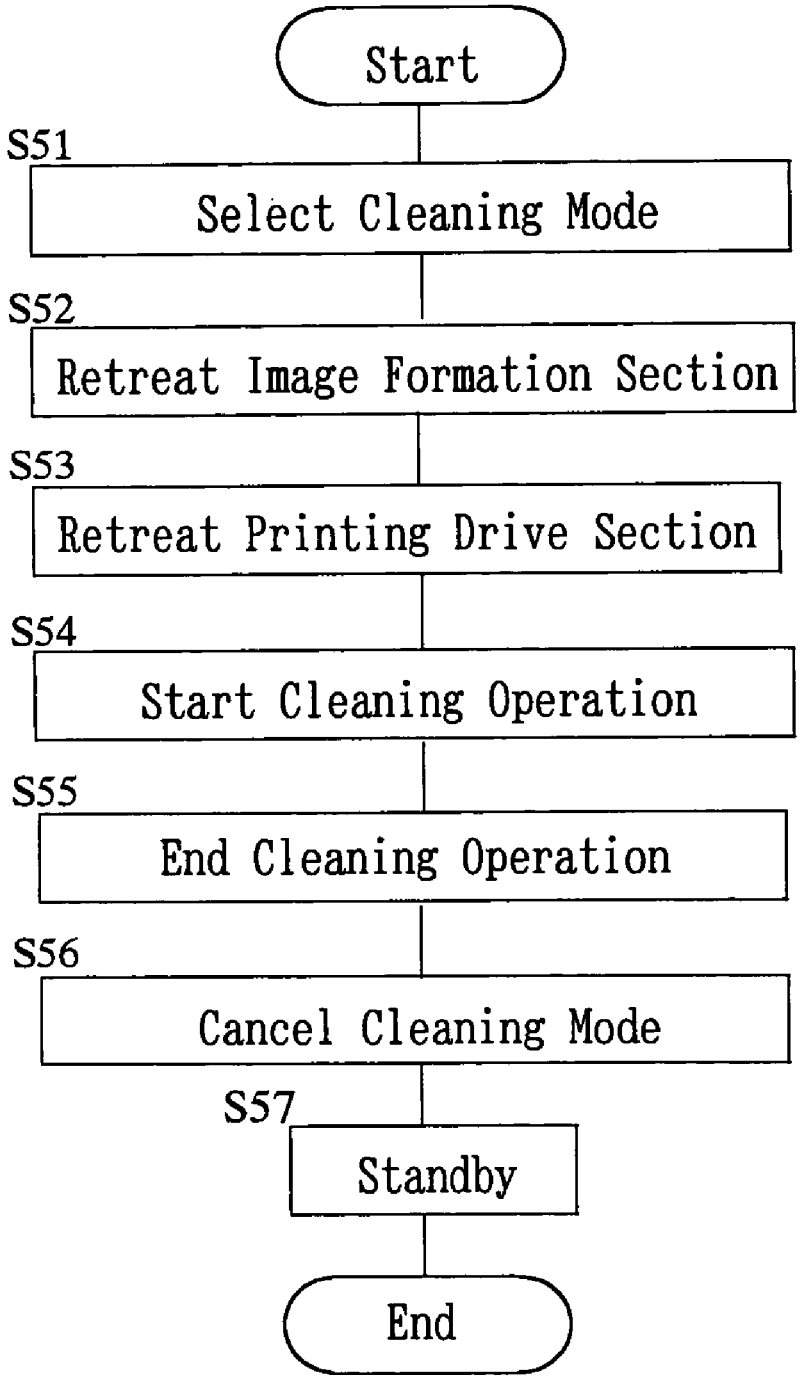
Fig.15 Prior Art
FIG. 15 is a flowchart for explaining control procedure.

After passing a position of transfer to the printing medium 10, a portion of the intermediate transfer member 1 on which an image is previously formed reaches the position of a cleaning unit 2. The cleaning unit 2 removes residual toner, whereby the intermediate transfer member 1 prepares for a next cycle of formation of images in the corresponding colors by means of the developing units 4, 5, 6, and 7. The above-described liquid-development electrophotographic apparatus can be configured to have a structure similar to a conventionally known structure, or the structure described previously with reference to FIG. 11, except for the structure of the cleaning unit 2.

Figure 2:
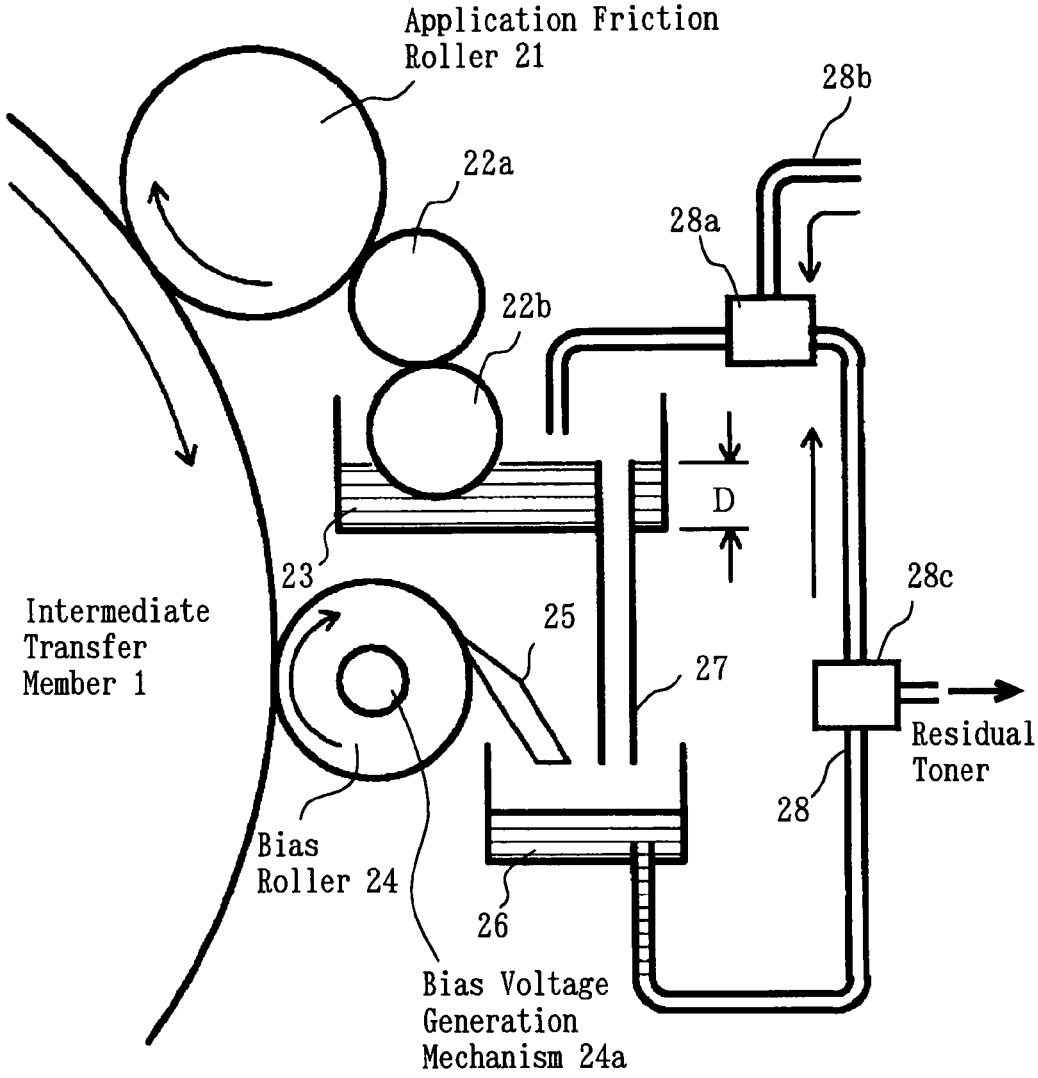
FIG. 2 is a view showing the details of a cleaning unit shown in FIG. 1.
Figure 3:
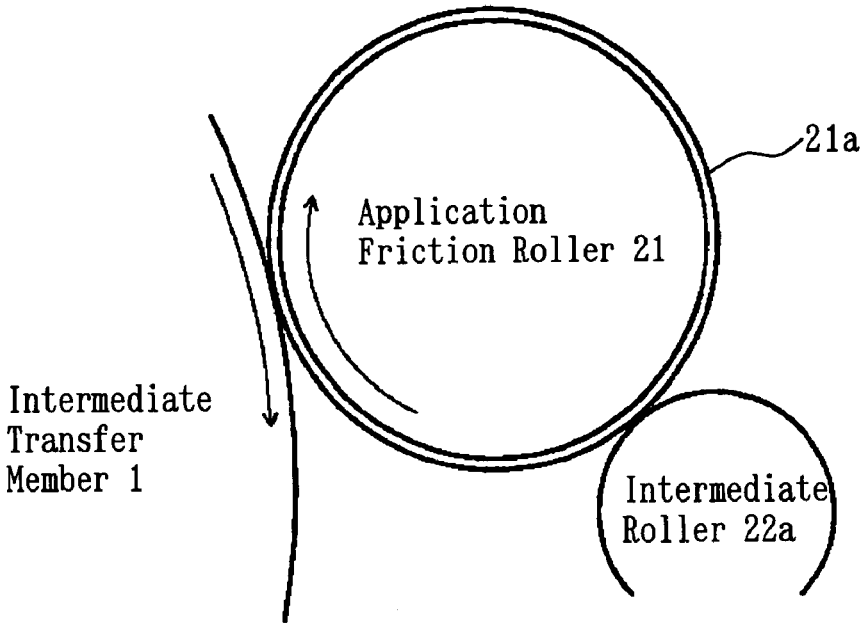
FIG. 3 is a view for explaining the details of the structure of an application friction roller.
Figure 4:
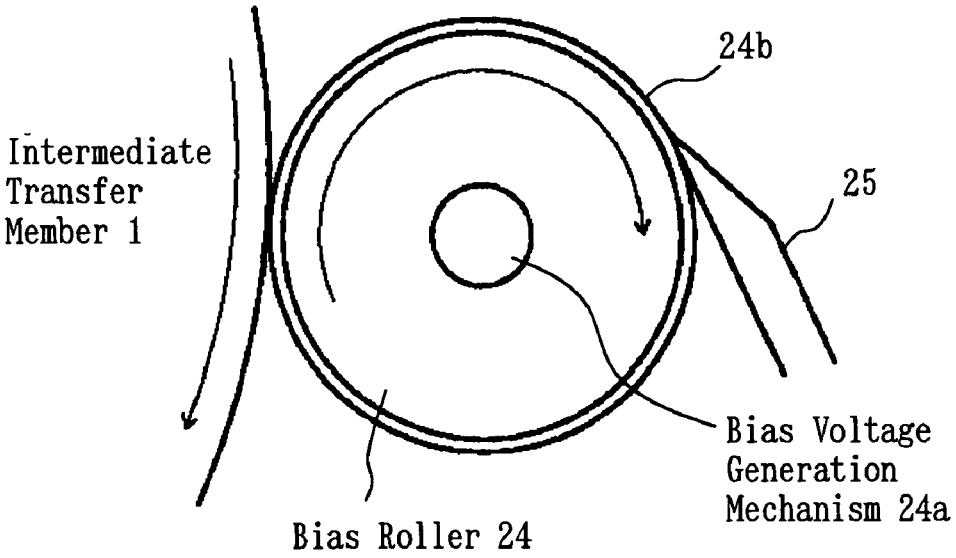
FIG. 4 is a view for explaining the details of the structure of a bias roller illustrated in FIG. 2.

Next, the cleaning unit, which is the feature of the present invention, will next be described in detail with reference to FIGS. 2 to 4, which show a first example of the cleaning unit. FIG. 2 is a view showing the details of the cleaning unit 2 shown in FIG. 1.

Residual developer which remains on the intermediate transfer member 1 without being transferred to a printing medium must be removed in a period to time ranging from the end of a transfer process in which the intermediate transfer member 1 makes one rotation to thereby transfer a toner image to the printing medium, to the start of a subsequent process in which a toner image is transferred from the photoconductor drum of the developing unit 4 to the intermediate transfer member 1. Thus, the cleaning unit 2 is located upstream of the developing unit 4 and downstream of the backup roller 9, which is disposed in opposition to the intermediate transfer member 1 provided for transferring a toner image to the printing medium.

As shown in FIG. 2, the cleaning unit 2 includes an application friction roller 21 and a bias roller 24, each of which presses the intermediate transfer member 1 at a predetermined pressure and is rotated in such a manner as to move at variable speed in an opposite direction with respect to movement of the intermediate transfer member 1. Notably, herein, the expression "to move in opposite directions" means that mutually facing portions move in opposite directions. According to this definition, for example, when two rollers in contact with each other rotate in the same direction (for example, rotate clockwise), contact portions of the rollers move in mutually opposite directions.

Although the details will be described later, the application friction roller 21 also has a function to apply a shear force to residual toner so as to exfoliate and disperse the residual toner in a cleaning liquid. The bias roller 24 includes a bias voltage generation mechanism 24*a* for applying a bias voltage between the bias roller 24 and the intermediate transfer member 1. Thus, the bias roller 24 has a function to weaken the force of adhesion of residual toner firmly adhering to the surface of the intermediate transfer member 1 through application of a bias voltage to the intermediate transfer member 1; to exfoliate the residual toner of weakened adhesion from the intermediate transfer member 1; and to disperse the exfoliated residual toner in a cleaning liquid. A collection blade 25 has the function to collect the thus-exfoliated, dispersed residual toner.

The application friction roller 21, intermediate rollers 22*a* and 22*b*, and a first pot 23 constitute an application mechanism for applying a cleaning liquid to the intermediate transfer member 1. The cleaning liquid is a substance substantially equal to a carrier liquid contained in a liquid toner used to form an image on the intermediate transfer member 1. For example, a nonvolatile liquid such as silicone oil is used as the cleaning liquid.

A cleaning liquid stored in the first pot 23 is taken out in such a manner as to adhere to the surface of the first intermediate roller 22*b*, which is rotated while being immersed in the stored cleaning liquid. Next, the cleaning liquid is transferred to the surface of the application friction roller 21 via the second intermediate roller 22*a*. The cleaning liquid which is transferred and adheres to the surface of the application friction roller 21 is transferred to the surface of the intermediate transfer member 1. As described previously, the cleaning liquid transferred to the surface of the intermediate transfer member 1 is a substance substantially equal to a carrier liquid. Thus, the cleaning liquid infiltrates into residual toner that firmly adheres to the surface of the intermediate transfer member 1, thereby weakening the force of adhesion of the residual toner.

Furthermore, while the surface of the application friction roller 21 which holds the cleaning liquid is pressed at a predetermined pressure against the intermediate transfer member 1, the application friction roller 21 and the intermediate transfer member 1 move in mutually opposite directions. Thus, residual toner firmly adhering to the surface of the intermediate transfer member 1 is subjected to a shear force which is induced by a frictional force of the application friction roller 21 and acts along the surface of the intermediate transfer member 1. The shear force induced by the frictional force of the application friction roller 21 and imposed on residual toner functions as a force of canceling the force of adhesion of the residual toner firmly adhering to the surface of the intermediate transfer member 1 to thereby exfoliate the residual toner from the intermediate transfer member 1. The residual toner exfoliated, by this shear force, from the surface of the intermediate transfer member 1 is dispersed in the cleaning liquid supplied from the application friction roller 21. This tells that the application friction roller 21 has a function to apply a cleaning liquid and a function to exfoliate residual toner through friction against the residual toner and disperse the residual toner in the cleaning liquid.

The application friction roller 21, the intermediate roller 22*a*, and the intermediate roller 22*b* can be configured in such a manner as to be rotated at variable speed. For example, when the rotational speed of the application friction roller 21 in contact with the surface of the intermediate transfer member 1 is increased, the surface area of the application friction roller 21 in sliding contact with a unit area of the surface of the intermediate transfer member 1 increases, and thus the quantity of friction and the quantity of cleaning liquid transferring from the surface of the application friction roller 21 to the surface of the intermediate transfer member 1 increase. In other words, the capability to exfoliate and disperse residual toner can be controlled through control of the rotational speed of the application friction roller 21 and the intermediate rollers 22*a* and 22*b*.

An outlet portion (distal end) of a drain mechanism 27 is located at height D above the bottom surface of the first pot 23. A supply port portion (distal end) of a reflux mechanism 28, which will be described later, is located above the liquid surface of the first pot 23. The maximum drain rate of the drain mechanism 27 is set higher than the maximum supply rate of the reflux mechanism 28. Through employment of this setting, the level of a cleaning liquid stored in the first pot 23 does not exceed a predetermined height (i.e., height D above the bottom surface) and does not drop below this predetermined height D.

Next, the details of the structure of the application friction roller 21 will be described with reference to FIG. 3. A surface layer 21*a* is formed on the surface of the application friction roller 21. The surface layer 21*a* is formed of a resin-material or rubber-material foam or a member (non-woven fabric, felt, or the like) made of fine fiber. When the application friction roller 21 transfers a cleaning liquid—which is transferred to the application friction roller 21 from the intermediate roller 22*a*—to the intermediate transfer member 1, the application friction roller 21 holds the cleaning liquid in pits of the surface layer 21*a* formed of a foam or fine fiber and stably applies the cleaning liquid; and projections of the surface layer 21*a* impose a shear force on residual toner firmly adhering to the intermediate transfer member 1, by means of a frictional force generated through continuous sliding of the projections.

Again with reference to FIG. 2, the bias roller 24 and its peripheral structures will be described in terms of configuration, action, and effect. The bias roller 24, the blade 25, and a second pot 26 constitute a collection mechanism for collecting, from the surface of the intermediate transfer member 1, a cleaning liquid which contains residual toner in a dispersed condition.

The surface of the bias roller 24 is in press contact with the surface of the intermediate transfer member 1 and moves in an opposite direction with respect to the surface of the intermediate transfer member 1; the bias roller 24 adsorbs residual toner through application of a bias voltage; and the bias roller 24 wipes off the cleaning liquid applied to the surface of the intermediate transfer member 1 to thereby collect the cleaning liquid. In so doing, residual toner dispersed in the cleaning liquid, together with the cleaning liquid, transfers from the surface of the intermediate transfer member 1 to the surface of the bias roller 24.

The residual toner and the cleaning liquid transferred to the surface of the bias roller 24 is scraped together by means of the blade 25 in contact with the bias roller 24 and is collected in the second pot 26. Thus, the residual toner which, previously, firmly adheres to the intermediate transfer member 1 is collected, together with the cleaning liquid, in the second pot 26 via the bias roller 24.

The bias roller 24 includes the bias voltage generation mechanism 24*a*, which applies a bias voltage between the bias roller 24 and the intermediate transfer member 1 located in opposition to the bias roller 24. This bias voltage weakens the force of adhesion of residual toner firmly adhering to the surface of the intermediate transfer member 1. As a result, the residual toner exfoliates from the intermediate transfer member 1; disperses in the cleaning liquid; and is adsorbed on the bias roller 24. This tells that the bias roller 24 has a function to collect residual toner and a function to exfoliate and disperse the residual toner by use of the bias voltage generation mechanism 24*a*.

The reflux mechanism 28 is connected to the bottom of the second pot 26, which collects the cleaning liquid containing the residual toner dispersed therein. The reflux mechanism 28 transfers the cleaning liquid from the second pot 26 to the first pot 23 by means of a reflux pump 28*a*. The reflux mechanism 28 includes a cleaning-liquid regeneration mechanism 28*c*, which removes residual toner dispersing in the cleaning liquid so as to prevent deterioration of the cleaning liquid for reuse. Notably, when the cleaning liquid from the second pot 26 is rendered unavailable, the reflux pump 28*a* changes over the cleaning-liquid supply source to a replenishment mechanism 28*b* and transfers a new cleaning liquid to the first pot 23 from a replenishment pot (not shown) connected to the replenishment mechanism 28*b*.

The details of the structure of the bias roller 24 shown in FIG. 2 will be described with reference to FIG. 4. A surface resin layer 24*b* is formed on the bias roller 24. The surface roughness of the surface resin layer 24*b* is set such that a 10-point average roughness (Rz) is 3 μm or less. Through retainment of this surface roughness, appropriate smoothness is ensured to the surface of the bias roller 24, whereby the blade 25 in contact with the bias roller 24 can efficiently and stably scrape off a cleaning liquid.

An electrical characteristic of the surface resin layer 24*b* formed on the surface of the bias roller 24 is set such that volume resistance substantially falls within a range of 10 kΩ to 10 GΩg. Through retainment of this volume resistance, the bias voltage generation mechanism 24*a* contained in the bias roller 24 can efficiently apply a bias voltage.

Notably, the above-described cleaning unit employs a roller structure for the application friction roller 21 and the bias roller 24. However, in place of a roller structure, a belt structure may be employed for the application friction roller 21 and/or the bias roller 24. Herein, the term "rotary member" means a structure in which continuously repetitive portions of a mobile member circulate and sequentially perform a predetermined operation, such as a structure implemented by the surface of, for example, such a roller or belt.

Figure 5:
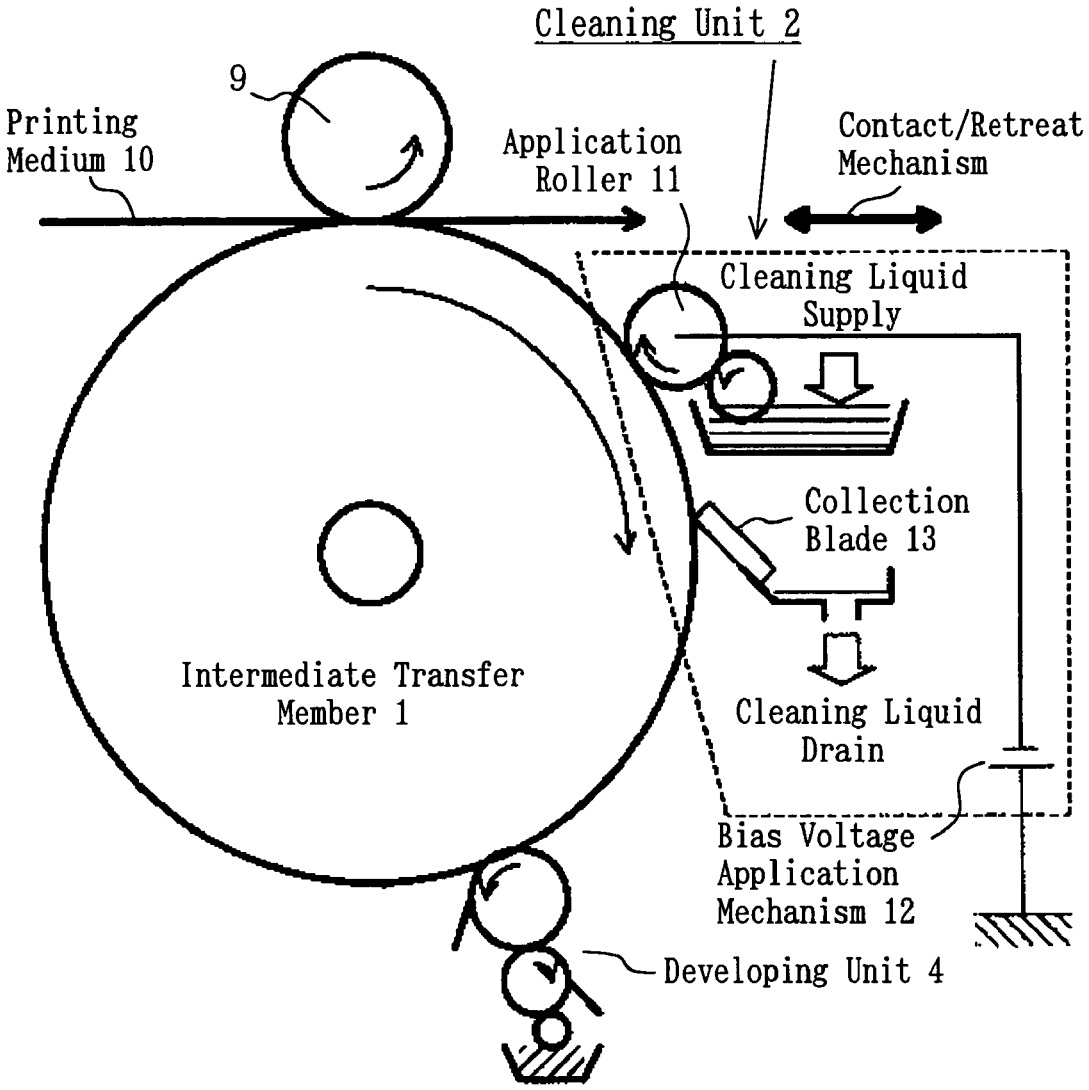
FIG. 5 is a view showing a second example of a cleaning apparatus to which the present invention is applied.

FIG. 5 is a view showing a second example of a cleaning apparatus to which the present invention is applied. In FIG. 5, as in the case of the first example, the cleaning unit 2 is located upstream of the developing unit 4 and downstream of the backup roller 9, which is disposed in opposition to the intermediate transfer member 1 provided for transferring a toner image to the printing medium 10.

The cleaning unit 2 includes a cleaning-liquid application roller 11, a bias voltage application mechanism 12, and a collection blade 13. The cleaning unit 2 is configured in such a manner as to be able to come into contact with and retreat from the intermediate transfer member 1 by means of a contact/retreat mechanism.

The cleaning-liquid application roller 11 applies a cleaning liquid to the intermediate transfer member 1 which has transferred an image to the printing medium 10. This cleaning-liquid application roller 11 is appropriately supplied with a cleaning liquid from a storage pot via an intermediate roller. The cleaning liquid applied by the cleaning-liquid application roller 11 is infiltrated into residual developer remaining on the intermediate transfer member 1 to thereby weaken cohesion/firm adhesion of residual developer to the intermediate transfer member 1 and again liquefies the residual developer cohering/firmly adhering to the intermediate transfer member.

The bias voltage application mechanism 12 is adapted to apply, to the intermediate transfer member 1, a bias voltage opposite in polarity to charged toner particles of developer (a bias voltage polarized in such a direction as to cause exfoliation of developer). Notably, in the present embodiment, charged toner particles assume the plus polarity. The bias voltage application mechanism 12 applies, between the application roller 11 and the intermediate transfer member 1, a bias voltage polarized in such a direction as to cause exfoliation of developer, thereby weakening the force of cohesion/adhesion of residual developer and exfoliating from the intermediate transfer member 1 the residual developer remaining on the intermediate transfer member 1 or the liquefied residual developer.

The collection blade 13 collects the cleaning liquid which has been applied by means of the cleaning-liquid application roller 11, and residual developer exfoliated from the intermediate transfer member 1 or liquefied residual developer. The collected cleaning liquid is drained as appropriate.

According to the above-described configuration, the liquid-development electrophotographic apparatus using a liquid developer performs cleaning in the following manner. The force of cohesion/adhesion of residual developer remaining on the intermediate transfer member is weakened, and the residual developer of weakened cohesion/adhesion is exfoliated from the intermediate transfer member. Alternatively, residual developer cohering/firmly adhering to the intermediate transfer member is again liquefied. The thus-treated residual developer, together with a cleaning liquid, is collected. Accordingly, residual developer which coheres/firmly adheres to the intermediate transfer member in a stubborn manner can be effectively and stably cleaned off.

Figure 6:
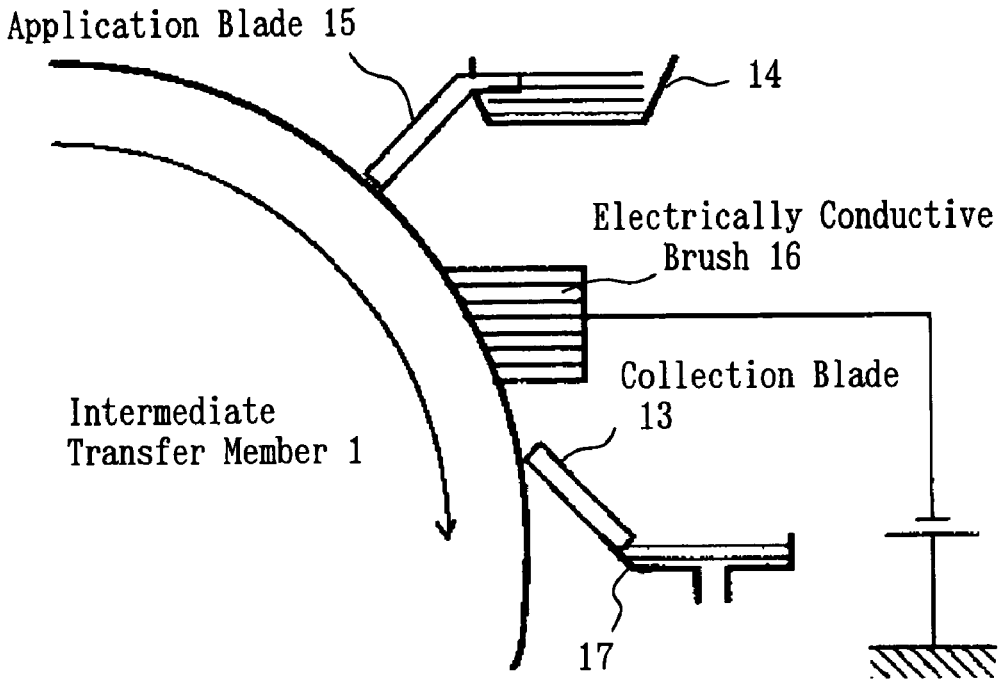
FIG. 6 is a view showing a third example of a cleaning apparatus to which the present invention is applied.

FIG. 6 is a view showing a third example of a cleaning apparatus to which the present invention is applied. In FIG. 6, in order to apply a cleaning liquid to the intermediate transfer member 1, an application blade 15 formed of a felt material is provided at a position where it faces a portion of the intermediate transfer member 1 which has passed the position of image transfer to the printing medium. The application blade 15 is supplied with a cleaning liquid supplied to a supply pan 14. The cleaning liquid supplied to the supply pan 14 is controlled as appropriate so as to maintain a constant liquid level. Also, preferably, in order to heat residual developer remaining on the intermediate transfer member 1 to a temperature equal to or higher than the softening point of resin contained in the developer, a cleaning liquid heated to a predetermined temperature is supplied to the supply pan 14 for application thereof.

An electrically conductive brush 16 is used at a position located downstream of the application blade 15 on the intermediate transfer member 1. The electrically conductive brush 16 is formed of an electrical conductor and adapted to apply, to the intermediate transfer member 1, a bias voltage opposite in polarity to charged toner particles of the developer (a bias voltage polarized in such a direction as to cause exfoliation of developer).

Furthermore, the collection blade 13 for removing, from the intermediate transfer member 1, the cleaning liquid which has been applied by means of the application blade 15, and residual developer which remains on the intermediate transfer member 1 without being transferred to the printing medium, is provided downstream of the electrically conductive brush 16 on the intermediate transfer member 1. The collection blade 13 is in elastic press contact with the intermediate transfer member 1 and collects, in a collection pan 17, residual developer exfoliated from the intermediate transfer member 1 and the cleaning liquid which has been applied by means of the application blade 15.

Figure 7:
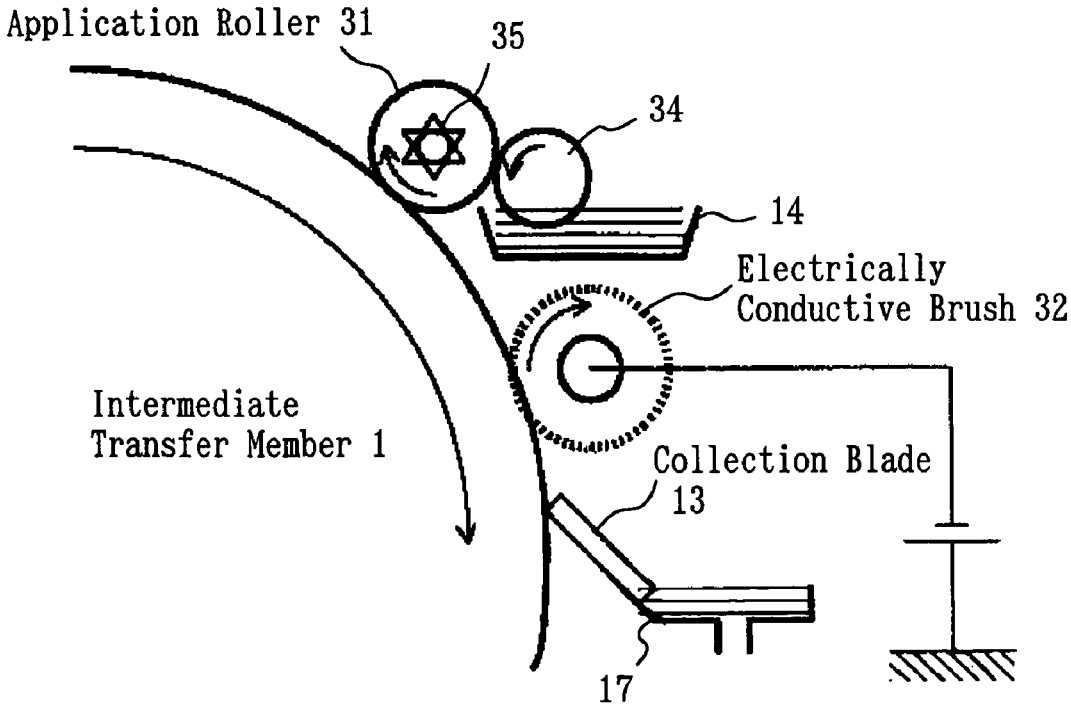
FIG. 7 is a view showing a fourth example of a cleaning apparatus to which the present invention is applied.

FIG. 7 is a view showing a fourth example of a cleaning apparatus to which the present invention is applied. In FIG. 7, an application roller 31 for applying a cleaning liquid and rubbing residual toner remaining on the intermediate transfer member 1 is provided at a position where it faces a portion of the intermediate transfer member 1 which has passed the position of image transfer to the printing medium. The application roller 31 is rotated in such a direction that, in a contact zone where the application roller 31 is in contact with the intermediate transfer member 1, contact surfaces move in opposite directions. A cleaning liquid supplied to a supply pan 14 is supplied to the application roller 31 via a cleaning-liquid supply roller 34. Notably, the application roller 31 may be rotated in such a direction that, in a contact zone where the application roller 31 is in contact with the intermediate transfer member 1, contact surfaces move in the same direction.

Preferably, in order to heat residual developer remaining on the intermediate transfer member 1 to a temperature equal to or higher than the softening point of resin contained in the developer, the application roller 31 contains a heater 35 which is heated beforehand to a predetermined temperature.

An electrically conductive brush 32 is used at a position located downstream of the application roller 31 on the intermediate transfer member 1. The electrically conductive brush 32 assumes the form of a rotary member and is formed of an electrical conductor and adapted to apply, to the intermediate transfer member 1, a bias voltage opposite in polarity to charged toner particles of the developer (a bias voltage polarized in such a direction as to cause exfoliation of developer). The electrically conductive brush 32, which is a rotary member, is rotated in such a direction that, in a contact zone where the electrically conductive brush 32 is in contact with the intermediate transfer member 1, contact surfaces move in opposite directions. Notably, the electrically conductive brush 32 may be rotated in such a direction that, in a contact zone where the electrically conductive brush 32 is in contact with the intermediate transfer member 1, contact surfaces move in the same direction.

As in the case of the previously described configuration shown in FIG. 6, there is provided the collection blade 13 for removing, from the intermediate transfer member 1, the cleaning liquid which has been applied by means of the application roller 31, and residual developer which remains on the intermediate transfer member 1 without being transferred to the printing medium. The collection blade 13 is in elastic press contact with the intermediate transfer member 1 and collects, in the collection pan 17, residual developer exfoliated from the intermediate transfer member 1 and the cleaning liquid which has been applied by means of the application roller 31.

Figure 8:
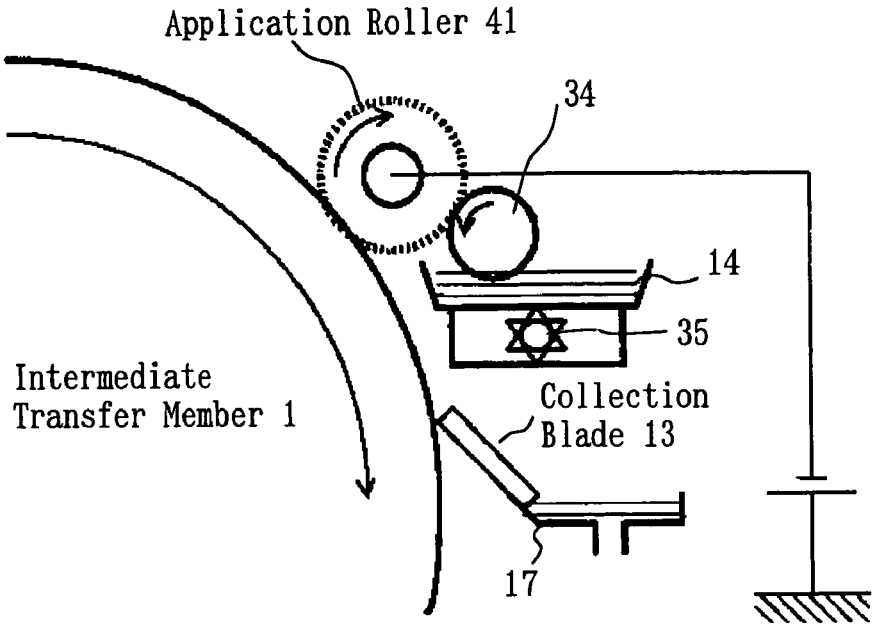
FIG. 8 is a view showing a fifth example of a cleaning apparatus to which the present invention is applied.

FIG. 8 is a view showing a fifth example of a cleaning apparatus to which the present invention is applied. In FIG. 8, an application roller 41 is provided at a position where it faces a portion of the intermediate transfer member 1 which has passed the position of image transfer to the printing medium. The application roller 41 is formed of an electrical conductor and adapted to apply, to the intermediate transfer member 1, a carrier liquid and a bias voltage opposite in polarity to charged toner particles of the developer (a bias voltage polarized in such a direction as to cause exfoliation of developer). An electrically conductive brush is provided on the surface of the application roller 41. The application roller 41 including the electrically conductive brush is rotated in such a direction that, in a contact zone where the application roller 41 is in contact with the intermediate transfer member 1, contact surfaces move in opposite directions. A cleaning liquid supplied to the supply pan 14 is supplied to the application roller 41 including the electrically conductive brush, via the cleaning-liquid supply roller 34. Notably, the application roller 41 may be rotated in such a direction that, in a contact zone where the application roller 41 is in contact with the intermediate transfer member 1, contact surfaces move in the same direction.

Preferably, in order to heat residual developer remaining on the intermediate transfer member 1 to a temperature equal to or higher than the softening point of resin contained in the developer, the supply pan 14 contains the heater 35 for heating, to a predetermined temperature, the cleaning liquid to be supplied to the application roller 41.

As in the case of the previously described configuration shown in FIG. 6 or 7, there is provided the collection blade 13 for removing, from the intermediate transfer member 1, the cleaning liquid which has been applied by means of the application roller 41, and residual developer which remains on the intermediate transfer member 1 without being transferred to the printing medium. The collection blade 13 is in elastic press contact with the intermediate transfer member 1 and collects, in the collection pan 17, residual developer exfoliated from the intermediate transfer member 1 and the cleaning liquid which has been applied by means of the application roller 41.

According to the illustrated configuration, the application roller 41 applies a cleaning liquid to the intermediate transfer member 1 which has transferred an image to the printing medium, and applies a bias voltage to the intermediate transfer member 1 in such a direction as to cause exfoliation of developer, whereby the structure can be simplified.

As shown in FIGS. 6 to 8, the cleaning liquid or the cleaning-liquid application member is heated to a predetermined temperature, whereby residual developer remaining on the intermediate transfer member can be heated to a temperature equal to or higher than the softening point of resin contained in the developer, thereby weakening adhesion of the residual developer and enhancing cleaning performance. The heater may be contained in the cleaning-liquid application roller or the cleaning-liquid supply pan. Alternatively, the heater may be contained in the carrier-liquid application blade 15 (FIG. 6). This allows easy heating of a carrier liquid by means of a simple structure. Also, in the case where the application roller is rotated such that its surface moves in an opposite direction with respect to movement of the intermediate transfer member, friction in a contact zone between the intermediate transfer member and the rotary member increases, thereby enhancing cleaning performance.

Figure 9:
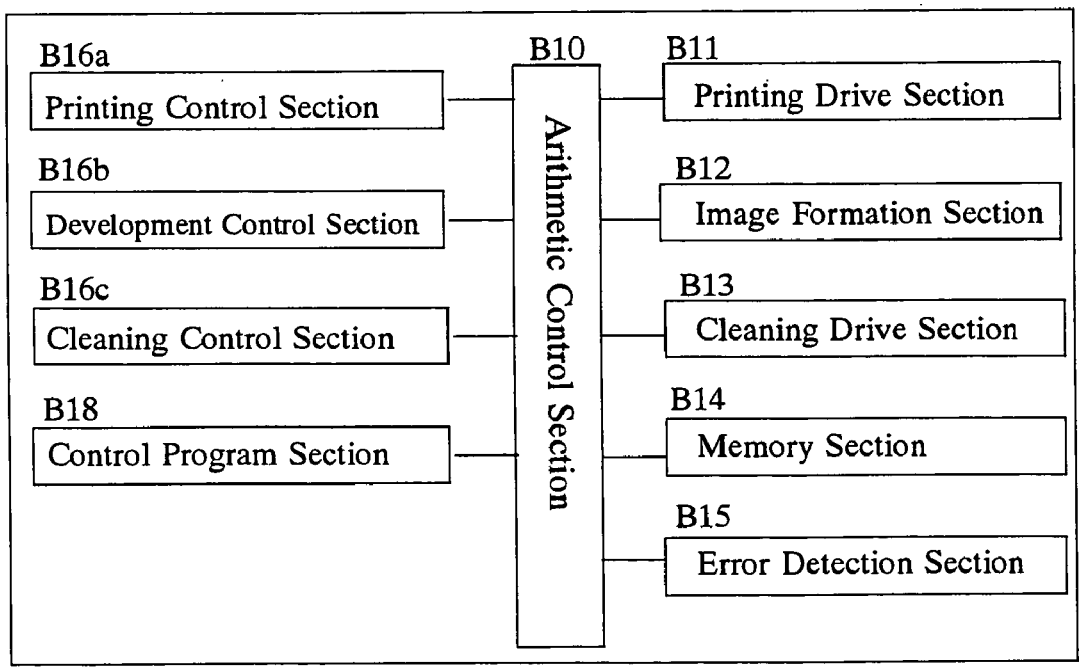
FIG. 9 is a block diagram for explaining a control system configuration for controlling a cleaning operation which the liquid-development electrophotographic apparatus performs in a cleaning mode.
Figure 10:
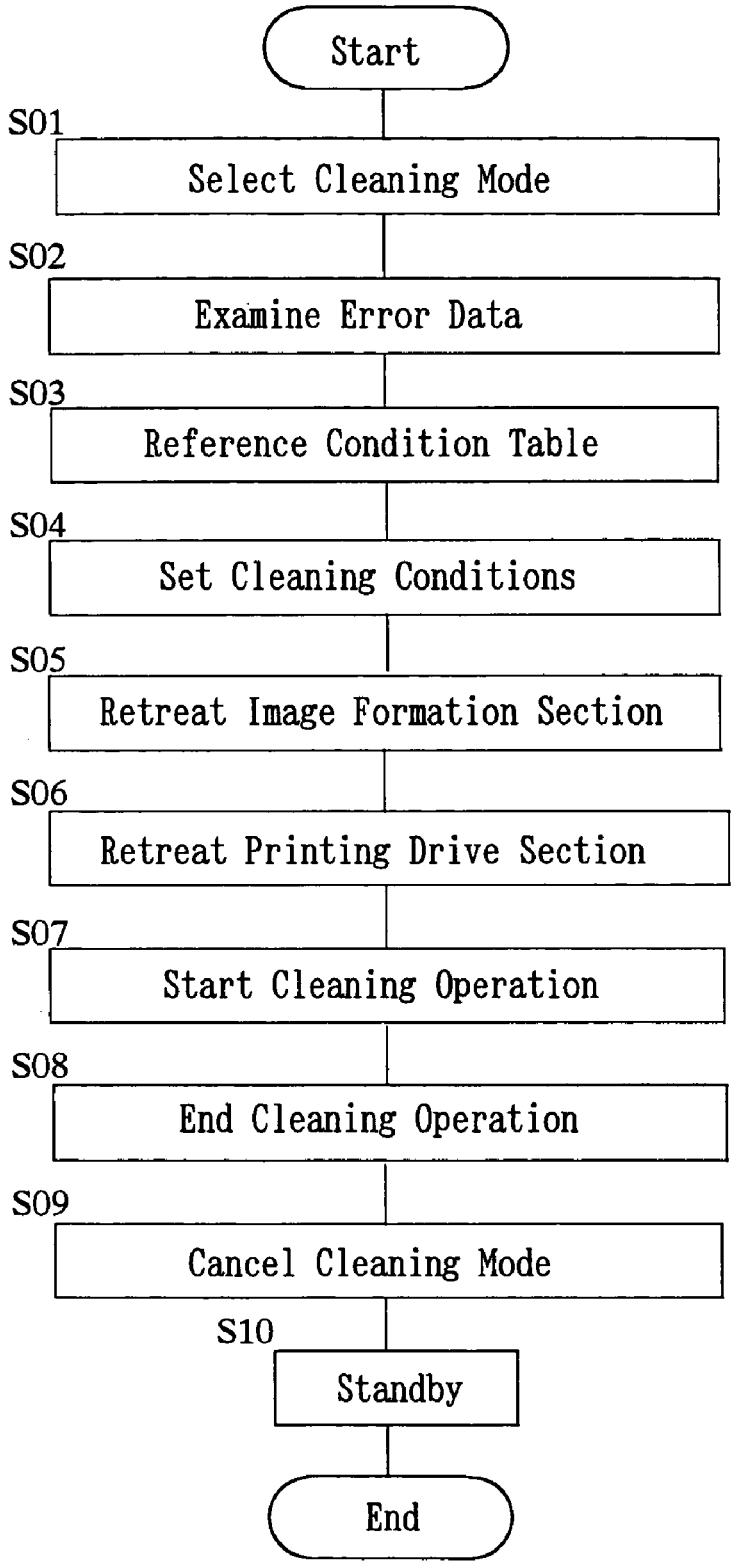
FIG. 10 is a flowchart for explaining control procedure.

Next will be described, with reference to FIGS. 9 and 10, control which the liquid-development electrophotographic apparatus performs in carrying out a cleaning operation corresponding to a cleaning mode. FIG. 9 is a block diagram for explaining a control system configuration. An arithmetic control section B10 contained in a liquid-development electrophotographic apparatus B01 fetches a required program segment from a control program stored in a control program section B18 and executes a predetermined control procedure.

A printing drive section B11 includes a drive system for driving the intermediate transfer member 1 illustrated in FIG. 1 and a press-contact drive system for driving the backup roller 9 illustrated in FIG. 1. An image formation section B12 includes drive systems for driving the corresponding developing units 4, 5, 6, and 7 illustrated in FIG. 1, and a drive system for driving the carrier-removing unit 8 illustrated in FIG. 1. A cleaning drive section B13 includes components of the cleaning unit 2, and mechanisms provided around the periphery of the components. A memory section B14 stores a cleaning condition table, which will be described later.

An error detection section B15 reports to the arithmetic control section B10 signals obtained from various error detection sensors disposed in the liquid-development electrophotographic apparatus B01. On the basis of the type of an error detection signal reported from the error detection section B15, the arithmetic control section B10 sets an operation pattern of a cleaning mode.

A printing control section B16*a* specifies an operation which the printing drive section B11 is to perform, timing of performing the operation, and the like; a development control section B16*b* specifies an operation which the image formation section B12 is to perform, timing of performing the operation, and the like; and a cleaning control section B16*c* specifies an operation which the cleaning drive section B13 is to perform, timing of performing the operation, and the like.

Control procedure will be described with reference to the flowchart of FIG. 10. In Step S01, an operator selects a cleaning mode as an operation mode of the liquid-development electrophotographic apparatus B01; and the arithmetic control section B10 fetches a program segment related to the cleaning mode from the control program section B18 and specifies a predetermined control procedure.

For example, when the number of image formation operations performed by the liquid-development electrophotographic apparatus B01 reaches a predetermined value, or when the liquid-development electrophotographic apparatus B01 detects an error which requires cleaning for recovery, the liquid-development electrophotographic apparatus B01 indicates necessity to perform cleaning, thereby reporting to the operator.

In Step S02, the arithmetic control section B10 examines the contents of error data (data indicative of, for example, which sensor has detected an error) reported from the error detection section B15.

In Step S03, the arithmetic control section B10 references the cleaning condition table stored in the memory section B14. Then, proceeding to Step S04, the arithmetic control section B10 sets cleaning conditions corresponding to the combination of error data. Specifically, for example, when the error detection section B15 detects a paper jam, the intermediate transfer member 1 is considered to carry a large quantity of toner as residual toner because of nonexecution of transfer. Thus, the arithmetic control section B10 lowers the rotational speed of the intermediate transfer member 1 and raises the rotational speed of the application friction roller 21 so as to increase the quantity of application of a cleaning liquid. Notably, the correspondence between the status of an error and a remedial action is determined beforehand and written in the cleaning condition table.

Through use of this principle, the liquid-development electrophotographic apparatus B01 can set a corresponding table which defines the correspondence between the contents of the obtained error data and cleaning conditions, to thereby construct a foundation for automatically setting cleaning conditions by classifying the error data.

In Step S05, the development control section B16*b* retreats the image formation section B12. Specifically, this retreat operation causes the developing units 4, 5, 6, and 7 and the carrier-removing unit 8 illustrated in FIG. 1 to separate from the intermediate transfer member 1.

In Step S06, the printing control section B16*b* retreats the printing drive section B11. Specifically, this retreat operation causes the backup roller 9 illustrated in FIG. 1 to separate from the intermediate transfer member 1.

In Step S07, the arithmetic control section B10 starts a cleaning operation. Specifically, in this cleaning operation, the intermediate transfer member 1 rotates for a predetermined period of time while remaining in contact with the cleaning unit 2. The cleaning unit 2 performs a cleaning operation at a rotational speed which is determined on the basis of the previously set cleaning conditions. For example, in the case where a cleaning mode for recovery is set upon detection of an error indicating that passage of a printing medium is not detected, in order to cope with a large quantity of untransferred toner, cleaning conditions are set in such a manner as to lower the rotational speed of the intermediate transfer member and to raise the rotational speed of the collection roller. Also, for example, in the case where another cleaning mode is set based on data indicating that the cumulative number of image formation operations has reached a predetermined value, in order to cope with stubbornly and firmly adhering residual toner, cleaning conditions are set in such a manner as to lower the rotational speed of the intermediate transfer member and to increase the rotational speed of the application roller.

In Step S08, the arithmetic control section B10 ends a cleaning operation. Then, proceeding to Step S09, the arithmetic control section B10 cancels the retreat operation of the image formation section B12 and the retreat operation of the printing drive section B11, performed for the cleaning mode. Subsequently, the arithmetic control section B10 proceeds to Step S10 and stands by in preparation for the subsequent image formation mode.

INDUSTRIAL APPLICABILITY

In cleaning of a liquid-development electrophotographic apparatus using a liquid developer, a cleaning liquid is applied to an intermediate transfer member which has transferred an image to a printing medium. The cleaning liquid infiltrates into residual developer remaining on the intermediate transfer member, thereby weakening cohesion/firm adhesion of the residual developer remaining on the intermediate transfer member. Furthermore, the cleaning liquid again liquefies the residual developer cohering/firmly adhering to the intermediate transfer member. Also, since a bias voltage is applied to the intermediate transfer member in such a direction as to cause exfoliation of developer, residual developer remaining on the intermediate transfer member is exfoliated from the intermediate transfer member. The residual developer exfoliated from the intermediate transfer member is collected together with the cleaning liquid. Thus, residual developer which coheres/firmly adheres to the intermediate transfer member in a stubborn manner can be effectively and stably cleaned off.

What is claimed is:

1. A cleaning method for a liquid-development electrophotographic apparatus in which, after a toner image formed on a surface of an intermediate transfer member by use of a liquid developer is transferred to a printing medium, the liquid developer remaining on the intermediate transfer member is removed and collected, comprising:

a cleaning-liquid application step of applying a cleaning liquid to the intermediate transfer member which has transferred an image to the printing medium;

a step of heating the residual developer on the intermediate transfer member to a temperature equal to or higher than a softening point of resin contained in the developer;

a bias voltage application step of applying, to the intermediate transfer member, a bias voltage opposite in polarity to charged toner particles of the residual developer; and a collection step of removing, from the intermediate transfer member, the cleaning liquid which has been applied in the cleaning-liquid application step, and the residual developer which remains on the intermediate transfer member without transfer of an image to the printing medium, and collecting the removed cleaning liquid and residual developer.

2. A cleaning method for a liquid-development electrophotographic apparatus as described in claim 1, further comprising a step of rubbing the intermediate transfer member by use of a resin-material or rubber-material foam or a member formed of fine fiber when the cleaning liquid is applied.

3. A cleaning apparatus for a liquid-development electrophotographic apparatus in which, after a toner image formed on a surface of an intermediate transfer member by use of a liquid developer is transferred to a printing medium, the liquid developer remaining on the intermediate transfer member is removed and collected, comprising:

a cleaning-liquid application device for applying a cleaning liquid to the intermediate transfer member which has transferred an image to the printing medium;

a heating device for heating the residual developer on the intermediate transfer member to a temperature equal to or higher than a softening point of resin contained in the developer;

a bias voltage application device for applying, to the intermediate transfer member, a bias voltage opposite in polarity to charged toner particles of the developer; and a collection device for removing, from the intermediate transfer member, the cleaning liquid which has been applied by means of the cleaning-liquid application device, and the residual developer which remains on the intermediate transfer member without transfer of an image to the printing medium, and collecting the removed cleaning liquid and residual developer.

4. A cleaning apparatus for a liquid-development electrophotographic apparatus as described in claim 3, further comprising a friction device for rubbing the intermediate transfer member by use of a resin-material or rubber-material foam or a member formed of fine fiber when the cleaning liquid is applied.

5. A cleaning apparatus for a liquid-development electrophotographic apparatus as described in claim 3, wherein the cleaning-liquid application device comprises a first blade for applying the cleaning liquid; the bias voltage application device comprises an electrically conductive brush formed of an electrical conductor and adapted to apply a bias voltage; and the collection device comprises a second blade for removing the applied cleaning liquid and the residual developer from the intermediate transfer member.

6. A cleaning apparatus for a liquid-development electrophotographic apparatus as described in claim 3, wherein the cleaning-liquid application device comprises a rotary member for applying the cleaning liquid; the bias voltage application device comprises an electrically conductive brush formed of an electrical conductor and adapted to apply a bias voltage; and the collection device comprises a blade for removing the applied cleaning liquid and the residual developer from the intermediate transfer member.

7. A cleaning apparatus for a liquid-development electrophotographic apparatus as described in claim 3, wherein the cleaning-liquid application device comprises a rotary member formed of an electrical conductor and adapted to apply the cleaning liquid; a bias voltage opposite in polarity to charged toner particles of the developer is applied between the rotary member and the intermediate transfer member, whereby the rotary member functions as the bias voltage application device; and the collection device comprises a blade for removing the applied cleaning liquid and the residual developer from the intermediate transfer member.

8. A cleaning apparatus for a liquid-development electrophotographic apparatus as described in claim 3, further comprising either or both of a rotary member abutting the intermediate transfer member for applying the cleaning liquid to the intermediate transfer member and a rotary member abutting the intermediate transfer member for applying a bias voltage, wherein the rotary members are rotated such that, in a contact zone where the rotary members are in contact with the intermediate transfer member, contact surfaces move in opposite directions.

9. A cleaning apparatus for a liquid-development electrophotographic apparatus as described in claim 3, further comprising a first pot for supplying the cleaning liquid to the cleaning-liquid application device; a second pot for storing the cleaning liquid which the collection device collects and in which the residual developer disperses; a drain mechanism for leading, to the second pot, a portion of the cleaning liquid which would otherwise raise a liquid level of the first pot above a predetermined liquid level; and a reflux mechanism for refluxing the cleaning liquid from the second pot to the first pot.

10. A cleaning apparatus for a liquid-development electrophotographic apparatus as described in claim 9, wherein the reflux mechanism comprises a cleaning-liquid regeneration mechanism for regenerating the cleaning liquid through removal of the residual developer.

11. A cleaning apparatus for a liquid-development electrophotographic apparatus as described in claim 3, wherein, when the liquid-development electrophotographic apparatus is to perform a cleaning operation corresponding to a cleaning mode, rotation control of a rotary member which partially constitutes the cleaning apparatus, and rotation control of the intermediate transfer member subjected to cleaning are separately set according to an error mode corresponding to a condition of an error detected by an error detection mechanism provided in the liquid-development electrophotographic apparatus.

* * * * *